United States Patent [19]

Graves et al.

[11] Patent Number: 4,499,401

[45] Date of Patent: Feb. 12, 1985

[54] TRIPLE COIL INCANDESCENT FILAMENT

[75] Inventors: James A. Graves, Highland Heights; Gilbert H. Reiling, Chardon, both of Ohio

[73] Assignee: General Electric Company, Schenectady, N.Y.

[21] Appl. No.: 471,609

[22] Filed: Mar. 3, 1983

[51] Int. Cl.[3] ..... H01K 1/14

[52] U.S. Cl. ..... 313/315; 313/344; 313/345

[58] Field of Search ..... 313/315, 344, 345

[56] References Cited

U.S. PATENT DOCUMENTS

| | | | |
|---|---|---|---|
| 2,218,345 | 10/1940 | Spaeth | 313/344 X |
| 2,306,925 | 12/1942 | Aicher | 313/344 X |
| 2,329,126 | 9/1943 | Lemmers | 313/344 X |
| 3,003,077 | 10/1961 | Thomas | 313/344 X |
| 3,294,125 | 12/1966 | Heine | 313/344 X |
| 4,316,116 | 2/1982 | Graves | 313/344 |

*Primary Examiner*—Saxfield Chatmon

*Attorney, Agent, or Firm*—John P. McMahon; Philip L. Schlamp; Fred Jacob

[57] ABSTRACT

This invention relates to a single strand filament wire arranged into a triple-coil filament for an incandescent lamp. The triple-coil filament has selected dimensions that do not require recrystallization of the tungsten wire of the triple-coil filament prior to arranging the triple-coil filament within the incandescent lamp.

3 Claims, 6 Drawing Figures

Fig. 2
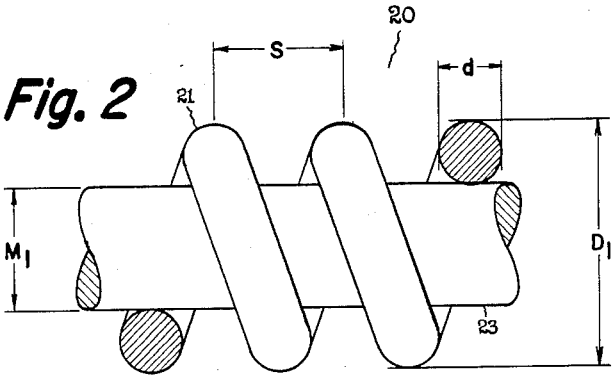
Fig. 1
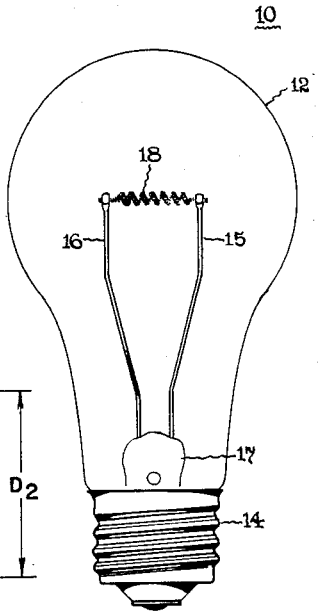
Fig. 3
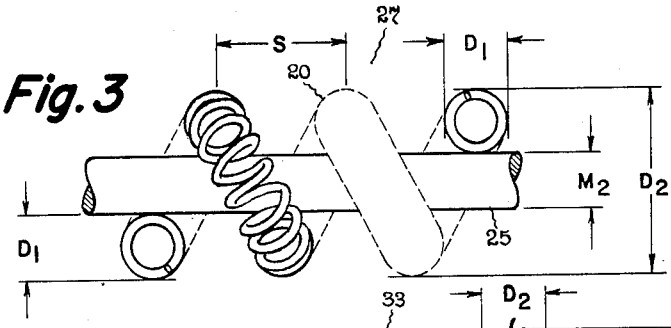
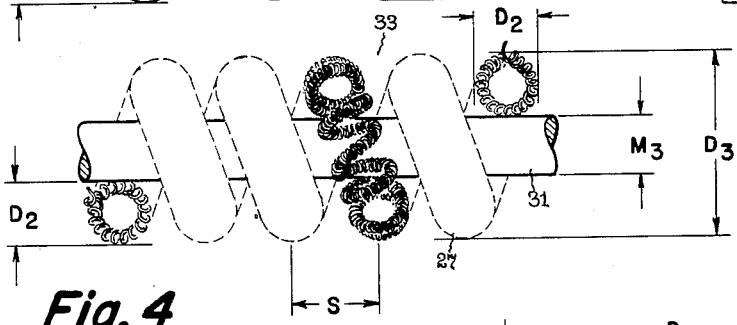
Fig. 4
Fig. 5
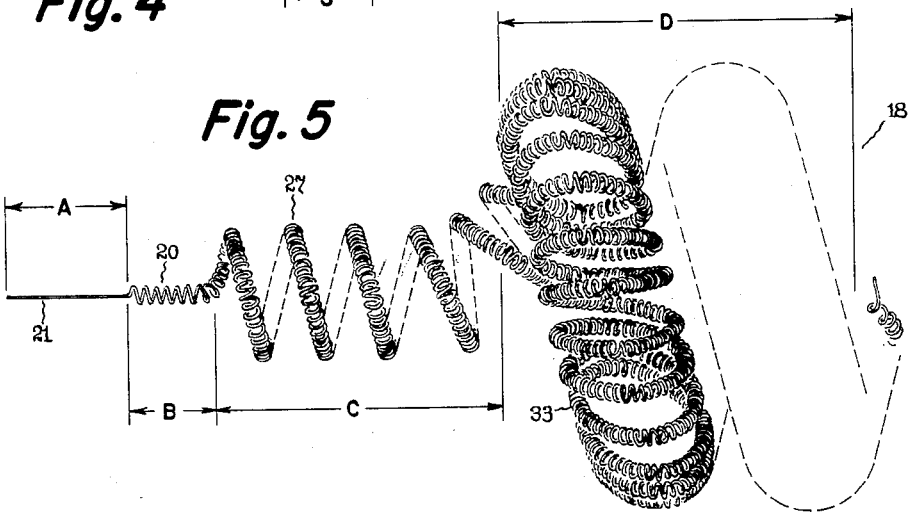

TRIPLE COIL INCANDESCENT FILAMENT

BACKGROUND OF THE INVENTION

This invention relates to multiple coil incandescent filaments, and more particularly, to a single strand filament wire, coreless, triple-coil filament for an incandescent lamp.

The light output of incandescent lamps is proportional to the light-emitting surface area of the light source. An incandescent lamp having a triple-coil filament, that is, a coiled-coiled-coil filament is advantageous as a light source in that it allows for an approximate three fold increase in the light-emitting surface area relative to a single filament and when arranged into an incandescent lamp provides an improved efficacy of the incandescent lamp.

Triple coil filaments are known in the art of incandescent lamp and are taught, for example, in United Kingdom (UK) Patent Specification No. 475,006 of Nov. 16, 1936 of E. I. Lonn and our U.S. Pat. No. 4,316,116, issued Feb. 16, 1982.

UK Patent Specification No. 475,006 discloses a triple-coil filament having various diameters and coiling cores for the first, second and third coils of the triple-coil filament. The UK Patent Specification No. 475,006 disclosing desired properties which may conceivably yield a triple-coil filament having an outside diameter in the range of (26.1 to 50.6) d, where d is the diameter of the filament wire.

A triple-coil filament having an outer diameter in the range of 26.1d to 50.6d presents problems relative to maintaining the geometry of the filament during lamp operation. It has been empirically determined that for such sized filaments having an outer diameter between 26.1d to 50.6d stress relieving or recrystallization processes need to be performed to the filament before arranging the filament within the incandescent lamp so that the geometry of the filament is maintained during the operation of the incandescent lamp.

Maintaining the geometry of the filament during incandescent lamp operation is needed so as to prevent the filament from sagging when the temperature of the filament is elevated to its operating temperature. If sagging is not prevented, the separated windings of the triple-coil filament may come into contact with each other which causes the filament to short-circuit itself and experience a burn-out. The undesirable filament burn-out is most pronounced for the inner coil spacing associated with the first wound coil of the triple-coil filament. It is considered desirable to provide a triple-coil filament not having the disadvantages related to the triple-coil filament of UK Patent Specification No. 475,006.

Our U.S. Pat. No. 4,316,116 teaches the incandescent art a triple-coil incandescent filament for the incandescent lamp having certain desired mandrel ratios so as to provide the desired triple-coil filament. Our U.S. Pat. No. 4,316,116 teaches a triple-coil filament having a maximum outside diameter which is less than 27d, where d is the diameter of the filament wire. Still further our U.S. patent teaches a triple-coil filament having a minimum outside diameter equal to 15d.

It has been determined in the practice of the teaching of U.S. Pat. No. 4,316,116 and by empirical data that the 27d outside diameter triple-coil filament is not particularly suitable for incandescent lamps. Triple-coil filaments having an outside diameter of 27d have been found to be of a flimsy structure which when arranged within the incandescent lamp without a recrystallization or stress relieving treatment experience sagging, which, in turn, as previously discussed with regard to the triple-coil filament of UK Patent Specification No. 475,006, causes the separated winding of the triple-coil filament to contact each other, which, in turn, causes the filament to experience a burn-out. The undesirable filament burn-out is most pronounced for the inner coil spacing associated with the first wound coil of the triple-coil filament.

In a manner similar to that described for the triple-coil filament of our U.S. Pat. No. 4,316,116 having an outer diameter of 27d, it has been determined by the practice of our invention of U.S. Pat. No. 4,316,116 and also by empirical data that the triple-coil filament of U.S. Pat. No. 4,316,116 having an outer diameter of 15d experiences problems related to maintaining its desired geometry within and during the operation of the incandescent lamp. More particularly, for the triple-coil filament having an outside diameter of 15d the first coiling pitch ratio has to be increased to a quantity which causes the lamp performance, that is, the efficacy of the lamp, to be reduced, and thus becomes less desirable.

It is considered desirable to provide the incandescent lamp art with a triple-coil filament having preselected dimensions that eliminates the need of recrystallization of the triple-coil filament prior to arranging the triple-coil filament within the incandescent lamp.

Accordingly, it is an object of the present invention to provide a triple-coil filament lamp allowing for a compact design and having design parameters further allowing for the integrity of the coil geometry of the triple-coil filament to be placed into an incandescent lamp without the need of prior recrystallization of the tungsten filament before lamp assembly.

Further objects and features and a more complete understanding of the present invention which may admit to a number of possible variations will be seen from the following description of our invention in conjunction with the attached drawings, representative of preferred embodiments of our invention.

SUMMARY OF THE INVENTION

The present invention is directed to a triple-coil incandescent filament having dimensions selected so as to eliminate the need of recrystallization of the tungsten filament prior to its arrangement within an incandescent lamp housing.

In one preferred embodiment, the incandescent lamp comprises an electrically conductive base having a hermetically sealed light-transmissive envelope attached thereto, means for structurally and electrically mounting a fixture within the envelope and a triple-coil filament electrically connected to and supported by the means for mounting. The triple-coil filament comprises a coiled-coiled-coil of tungsten wire having an outer diameter in the range of 20d to 26d, where d is the diameter of the wire forming the triple-coil filament.

BRIEF DESCRIPTION OF THE DRAWINGS

FIG. 1 is an illustration of a triple-coil filament arranged within an incandescent lamp.

FIG. 2 is an illustration of a filament wire which is wound around a first mandrel to form a coiled filament.

FIG. 3 is an illustration of the coil filament of FIG. 2 wound around a second mandrel to form a coiled-coil filament.

FIG. 4 is an illustration of a coiled-coil filament of FIG. 3 wound around a third mandrel to form a triple-coil filament configuration.

FIG. 5 is an illustration of a triple-coil filament in perspective view.

DETAILED DESCRIPTION OF THE PREFERRED EMBODIMENTS

Figure 6:
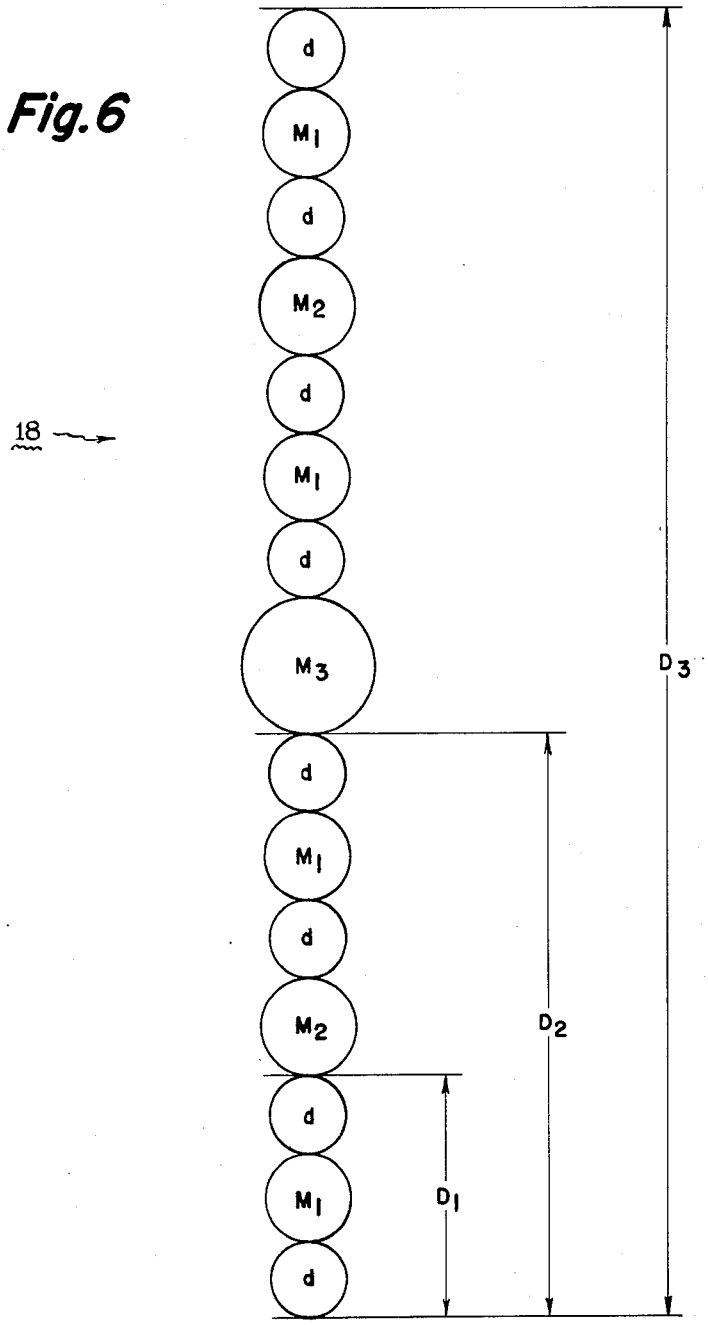
FIG. 6 is an illustration showing the various parameters related to determining the outer diameter of the triple-coil filament of the present invention.

FIG. 1 shows an incandescent lamp 10 having a hermetically sealed translucent envelope 12 sealed within a metallic base 14. Two electric lead and support wires 15 and 16 are rigidly disposed within the envelope 12 by a stem 17. A triple-coil filament 18 is clamped between the interior ends of the two lead wires 15 and 16 which electrically connect and support the filament 18. The opposite ends of the lead wires 15 and 16 extend through the stem 17 and make electrical connections (not shown) with appropriate portions of the metallic base 14 as known in the art. Although the particular mount arrangement as shown in FIG. 1 is for a CCC-6 or horizontal filament mount, the filament 18 may also be employed in alternate embodiments in a variety of mounting arrangements which may include for example a vertical or a CCC-8 mount.

Referring now to FIG. 2 which shows a primary filament coil 20 formed of a refractory metal wire 21 having a diameter d which is wound around a first mandrel 23 having a diameter $M_1$. The wire 21 in a preferred embodiment is a single strand fibrous tungsten wire having a diameter of 4.5 mils or less. The mandrel 23 in a preferred embodiment is molybdenum and has a diameter $M_1$ in the range of 0.9d to 1.5d, where d is the filament wire 21. The primary coil 20 has a diameter $D_1$ given by the following expression:

$$D_1=2d+M_1 \quad (1)$$

Referring now to FIG. 3, the primary coil 20 is wound around a second mandrel 25 to form a coiled-coil filament 27. The second mandrel 25 in a preferred embodiment is molybdenum and has a diameter $M_2$ of at least $1.0M_1$. The diameter $D_2$ of the coiled-coil filament is given by the following expression:

$$D_2=2D_1+M_2. \quad (2)$$

In FIG. 4, the coiled-coil filament is wound around a third mandrel 31 to form a triple-coil filament 33. The third mandrel 31 in a preferred embodiment is molybdenum and has a diameter $M_3$ of at least $1.0M_2$. The diameter of the triple-coil filament is $D_3$ and is given by the following expression:

$$D_3=2D_2+M_3 \quad (3)$$

Adjacent coil windings of the filament wires of FIGS. 2, 3 and 4 are each shown to have a separation S. The separation S (as shown in FIGS. 2, 3 and 4) is measured between the midpoint of adjacent windings along the filament. The separation S is established by winding the coil at a particular number of turns per inch (TPI). Adjacent coil winding should have sufficient separations to insure that the adjacent windings do not touch so as to be shorted to each other.

A further characteristic of the filaments of FIGS. 2, 3, and 4 is the pitch ratio $P_r$. The pitch ratio $P_r$ relate the winding separation S as a fraction of the coil or wire diameter wD and is defined as $P_r=(S/wD)$. In the first coiling, wD is the wire diameter d, in the second coiling, wD is the diameter of the first coil or $2d+M_1$, where $M_1$ is the diameter of the first mandrel.

In a manner similar to that related to the separation S of the filaments of FIGS. 2, 3 and 4, a sufficient pitch ratio $P_r$ should be considered so that adjacent coils are provided with a sufficient separation so as to prevent adjacent windings from touching and shorting each other.

FIG. 5 is an artist's representation of a triple-coiled filament 18 showing Sections A, B, C, and D, wherein section A is uncoiled filament wire 21, section B is a coiled filament 20, section C is a coiled-coil filament 27 and section D is a triple-coil filament 33. The triple-coil filament in a preferred embodiment incorporates and rigidly supports a large length of filament wire 21 of a high resistance R.

The filament resistance R of filament wire 21 is determined, in part, by selecting a refractory metal wire having a resistivity, at a specified temperature, which is defined as the resistance of a sample of the material of unit length per cross section (ohms per circular mil foot). The resistance R of the filament is established by selecting the length and cross-sectional area or diameter of the filament wire 21 as well as the composition of the refractory metal wire.

The filament wire 21 of the present invention for 120 volt-60 wattage application has a typical length of 554.6 mm (21.83 inches), a typical cross sectional area of $1.642.10^{-3}$ mm$^2$ ($2.545\times10^{-6}$ mils$^2$) and formed of a typical refractory metal composition of 218 tungsten wire. Similarly, for 230 volt-60 wattage applications the filament wire 21 may have a typical length of 1159 mm (45.63 inches), a typical cross sectional area of $6.354\times10^{-4}$ mm$^2$ ($9.852.10^{-7}$ mils$^2$) and is also formed of the composition of 218 tungsten wire. These parameters of wire length, cross-sectional area and compositions may be selected so that the filament 18 of the present invention is adapted to and encompasses a wide range of voltage and wattage applications typical associated with a general service incandescent lamp such as lamp 10 of FIG. 1.

The light output of a typical incandescent lamp is primarily dependent upon the nature of the filament employed therein. The incandescent lamp is characterized by its efficacy or lumens per watt. Lamp efficacy is dependent upon both the filament efficacy and the lamp atmosphere. Pressurized lamp atmospheres are commonly employed so as to impede the evaporation of tungsten within the lamp which improves the operation of the tungsten filament and also increases the life of the incandescent lamp.

Coiled filaments rather than uncoiled filaments are commonly employed to increase the efficacy of the lamp. Filaments coiled more than once exhibit still better efficacy than single-coiled filaments, inasmuch as the light-emitting surface area of the filament is increased without substantially increasing the heat dissipation of the filament. In accordance with the present invention, the triple coil through gains in geometry arrangements provides a compact light source which is especially advantageous for lamps such as infrared lamps and lamps of a CC8 type construction. Additionally, a triple-coil filament in accordance with the present invention increases the light-emitting surface of the filament relative to a coiled-coil filament without substantially increasing the heat losses of the filament and consequently improves the efficacy of the filament.

The triple-coil filament of the present invention is primarily achieved by providing an outer diameter D3 within the range of 20d to 26d, where d is the diameter of filament 21. The selection of the outer diameter D3 is best described by first referring to FIG. 6.

FIG. 6 shows the outer diameter D3 as comprised of the diameter d of filament wire 21, and mandrels $M_1$, $M_2$, and $M_3$ related to the first, second and third coiling, respectively, of FIGS. 2, 3, and 4. The diameter d and mandrels $M_1$, $M_2$ and $M_3$ are arranged in a stack like manner in order to simplify the following explanation relating to the determining of the outer diameter D3 of the triple-coiled filament 18.

From FIG. 6 it is seen that the dimension of the outer diameter D3 includes eight (8) filament wire 21 each having the diameter d. Further, from FIG. 6 it is seen that the dimension of D3 further includes four (4) mandrels $M_1$, two (2) mandrels $M_2$ and one mandrel $M_3$ centrally located within D3. The outer diameter D3 is selectable within the range 20d to 26d. The following expressions (4)–(11) are related to selecting an outer diameter D3 of a preferred value of 24d. In order that the outer diameter D3 may be specified in terms of the diameter d, it is best that the mandrel $M_1$ and $M_2$ be expressed in terms of d given by the following expressions:

$$M_1 = 0.9d \tag{4}$$

where 0.9d is the selected mandrel ratio of $M_1$ in terms of d.

$$M_2 = 1.4M_1 \tag{5}$$

where 1.4 is the selected mandrel ratio of $M_2$ relative to $M_1$.

The mandrel $M_2$ may now be expressed in terms of d as follows using expression:

$$M_2 = (1.4)(0.9\text{d}) = 1.26d \tag{6}$$

The mandrel $M_3$ may have a relationship expressed as:

$$M_2 = 1.4D2 \tag{7}$$

From FIG. 6 it is seen that, diameter D2 may be expressed as:

$$D2 = 4d + 2M_1 + M_2 \tag{8}$$

Using the relationships of expressions (4) and (5), the diameter D2 may be expressed in terms of d which is the diameter of the filament wire 21 as:

$$\begin{aligned} D2 &= 4d + 2\,(0.9d) + 1.4\,(0.9d) \\ &= 4d + 1.8d + 1.26d \\ &= 7.06d \end{aligned} \tag{9}$$

Selecting mandrel $M_3$ as having a ratio of 1.4 of D2 and then equating D2 in terms of d may be expressed as:

$$\begin{aligned} M_3 &= 1.4\,D2 \\ &= (1.4)\,(7.06d) \\ &= 9.884d \end{aligned} \tag{10}$$

Referring to FIG. 6, the outer diameter D3 of the triple-coil filament of the present invention having selected mandrels $M_1$, $M_2$ and $M_3$ with the relationships (4)–(7) may be expressed as:

$$\begin{aligned} D3 &= 8d + 4(M_1) + M_2 + M_3 \\ &= 8d + 4\,(0.9d) + 2\,(1.26d) + 9.884d \\ &= 8d + 3.6d + 2.52d + 9.884d \\ &= 24.004d \\ &= 24d \end{aligned} \tag{11}$$

Similar manipulation of expressions (4)–(11) using various values of mandrels $M_1$, $M_2$ and $M_3$ may be performed so as to obtain all the values of D3 within the range of 20d to 26d. This range of D3 for the triple coil filament 18 of the present invention has been selected primarily by a trial and error manner so as to result in this range of 20d to 26d not having the disadvantages discussed in the "Background" Section.

In the "Background" Section the UK Patent Specification No. 475,006 was mentioned as disclosing a triple-coil filament. The UK Patent Specification No. 475,006 on page 1, lines 91–103 discloses different ranges of an outer diameter of a triple spiral coil. The disclosed UK Patent Specification No. 475,006 having ratios of the diameters d:D1:D2:D3 chosen within the limits 1:09 to 1.8:3 to 8.2, and 8.5 to 19 which when taken in conjunction with FIG. 6 and expression (11) of this invention may yield an outer diameter somewhat similar to outer diameter D3 of our triple-coil filament 18. While theoretically, if one made a triple coil using the lowest ranges, given above, of the diameters D1, D2 and D3 of UK Patent Specification No. 475,006 the outer diameter of the triple coil could conceivably be 26.1d. However, unlike our invention nothing in UK Patent Specification No. 476,006 teaches or suggests any advantages to be gained approaching the lowermost end of its range that would provide any benefits such as obliterating the need of recrystallization of the tungsten filament prior to its arrangement within an incandescent lamp. Further, it should be recognized that the range of the outer diameter D3 of the present invention is sharply defined. For example, UK Specification No. 475,006 discloses a lower limit of 26.1 which we have determined as undesirable in that a triple-coil filament of 26.1d necessitates a recrystallization process to maintain the geometry of the filament under lamp operating conditions, whereas we teach a desirable lower limit of 26d not requiring recrystallization.

Further, mentioned in the "Background" Section, the outer diameter of 27d for the triple-coil filament of our U.S. Pat. No. 4,316,116 has been determined by a trial and error manner to be unsatisfactory in that a triple-coil filament having an outer diameter 27d necessitates a recrystallization process before the triple-coil filament is arranged within the incandescent lamp so that the geometry of the triple-coil filament is maintained under lamp operating conditions thereby preventing filament burn-out.

Still further, the outer diameter of 15d, mentioned in the "Background" section, for the triple-coil filament of our U.S. Pat. No. 4,316,116 has been determined by a trial and error manner to be unsatisfactory in that the first coiling pitch ratio has to be increased to a quantity which substantially reduces the desired efficacy of the lamp.

This relatively narrow range of 20d to 26d of the outer diameter D3 of the triple-coil filament of the present invention may be segmented into a more preferred, even though more restrictive, range of 24d to 26d. In addition to the desired range of the outer diameter D3 the pitch ratio $P_r$ previously described must be taken into account so as to avoid improperly wound triple-coil filament 18. It is desired that a pitch ratio $P_r$ of greater than 1.9 in a coiled or coiled-coil filament be avoided inasmuch as the separation S between the adjacent windings is relatively large, resulting in filaments which interwining and tangle. However, in a triple-coil filament these restrictions do not apply.

The triple-coil filament of the present invention having the desired outer diameter D3 in the range of 20d to 26d enables the use of fine wires for filament wire 21 that may be wound around mandrels $M_1$, $M_2$, and $M_3$ so as to provide a small, tightly but non-tangled incandescent light source. The mandrels ratios of the $M_1$, $M_2$ and $M_3$ mandrels allows coiling of the filament wire 21 which imparts strengh to the triple-coiled filament 18 and affords a rigid fine wire triple-coil filament that does not need recrystallization prior to be arranged within the incandescent lamp 10 of FIG. 1. The untreated non-recrystallized filament 18 does not experience sagging or distortion under filament operating conditions.

In a triple-coil filament of the present invention, the plane of the triple-coil filament 18 is approximately parallel to the axis of the filament. When the triple-coil filament 18 is flexed along its axis, the outside separation of the coiled-coil windings is increased while the separation between the primary coil windings 20 is substantially unaffected. Accordingly, the separation of the triple-coil filament of the present invention does not affect by or is not susceptible to filament tangling. The triple-coil filament of the present invention is substantially unrestricted so as to allow freedom of design to incorporate a variety of different filament wire lengths within a triple-coil for any given geometry having desired length and diameter parameters. For example, both a 220 volt and a 110 volt triple-coil filament can be formed in approximately the same geometry (diameter and length) by adjusting the ratios of mandrels $M_1$, $M_2$ and $M_3$. Inasmuch as the elasticity of tungsten typically forming the triple-coil 18 and molybdenum typically forming the mandrels $M_1$, $M_2$ and $M_3$ are approximately equal, an automated coiling machine may typically wind the filament wire 21 having the smaller diameter about a mandrel such as $M_1$ and $M_2$ having a selected diameter larger than the wire.

The triple-coil filament of the present invention is formed from a filament wire having a diameter of 4.5 mils or less is most advantageously used with mandrel ratio of the first mandrel $M_1$ of less than 1. This mandrel ratio of less than 1 is preferred in order that we provide a substantially rigid filament wire not susceptible to tangling or interaction between the filaments coiled.

What we claim as new and desire to secure by Letters Patent of the United States is:

1. An incandescent lamp comprising an electrically conductive base having a hermetically sealed light-transmissive envelope attached thereto, means for structurally and electrically mounting a filament within the said enclosure, a triple-coil filament electrically connected to and supported by said means for mounting, wherein said triple-coil filament comprises:

a coiled-coiled-coil of tungsten wire having an outer diameter D3 in the range of 20d to 26d, where d is the diameter of the tungsten wire said triple coil filament with the given range having a coil geometry that allows its successful arrangement within said incandescent lamp without sagging and without the need of prior recrystallization or stress-relieving treatment.

2. An incandescent lamp according to claim 1 wherein the outer diameter D3 has a preferred range of 24d to 26d.

3. An incandescent lamp according to claim 1 wherein said coiled-coiled-coil has a pitch ratio of greater than 1.9.

* * * * *